US007687737B2

(12) United States Patent
Zimmermann et al.

(10) Patent No.: US 7,687,737 B2
(45) Date of Patent: Mar. 30, 2010

(54) PROCESS AND DEVICE FOR SORTING FLAT POSTAL ITEMS

(75) Inventors: Armin Zimmermann, Constance (DE); Dirk-Udo Eisser, Reichenau (DE)

(73) Assignee: Siemens Aktiengesellschaft, Munich (DE)

( * ) Notice: Subject to any disclaimer, the term of this patent is extended or adjusted under 35 U.S.C. 154(b) by 543 days.

(21) Appl. No.: 10/592,402

(22) PCT Filed: Feb. 3, 2005

(86) PCT No.: PCT/EP2005/001073

§ 371 (c)(1),
(2), (4) Date: Sep. 11, 2006

(87) PCT Pub. No.: WO2005/092524

PCT Pub. Date: Oct. 6, 2005

(65) Prior Publication Data

US 2007/0205143 A1 Sep. 6, 2007

(30) Foreign Application Priority Data

Mar. 13, 2004 (DE) ..... 10 2004 012 378

(51) Int. Cl.
*B07C 5/00* (2006.01)

(52) U.S. Cl. ..... 209/583; 209/584; 209/900; 271/272

(58) Field of Classification Search ..... 209/583, 209/584, 900; 271/272; 700/219, 221, 223, 700/224, 225, 226
See application file for complete search history.

(56) References Cited

U.S. PATENT DOCUMENTS

| | | | | |
|---|---|---|---|---|
| 6,023,034 | A * | 2/2000 | Nakajima et al. | 209/584 |
| 6,612,572 | B1 | 9/2003 | Mohr et al. | |
| 2005/0027392 | A1 * | 2/2005 | Elliot et al. | 700/227 |

FOREIGN PATENT DOCUMENTS

| | | | |
|---|---|---|---|
| DE | 196 09 068 | A1 | 9/1997 |
| JP | 2000024598 | A | 1/2000 |
| WO | 9732674 | A1 | 9/1997 |
| WO | WO 01/09018 | A1 | 2/2001 |

OTHER PUBLICATIONS

Derwent Abstract—DE 196 09 068 A1; Sep. 11, 1997; AEG Electrocom GmbH, D-78467 Konstanz, Germany.

* cited by examiner

*Primary Examiner*—Patrick H Mackey
*Assistant Examiner*—Ernesto Suarez
(74) *Attorney, Agent, or Firm*—Laurence A. Greenberg; Werner H. Stemer; Ralph E. Locher

(57) ABSTRACT

In a method for sorting flat mail items, mail items are routed longitudinal direction according to determined destination addresses via a transport and point section into sorting terminals assigned to the destination addresses. Gaps between two mail items are adjusted by a controllable gap adjustment device in front of the transport and point. The average set gap between mail items leaving the separation device is selected to be smaller than the minimum gap between the mail items, which are to be sorted in the sorting terminals with the longest transport distances. The gaps between two mail items are adjusted by means of the controllable gap adjustment device as a function of the mail item with the shorter transport distance to the assigned sorting terminal in each instance. To create necessary space to displace the mail items in the flow of mail items, disruptive mail items are ejected.

10 Claims, 3 Drawing Sheets

PROCESS AND DEVICE FOR SORTING FLAT POSTAL ITEMS

BACKGROUND OF THE INVENTION

The invention relates to a method and a device for sorting flat mail items.

In corresponding sorting systems, the mail items are transported at high speeds and at small distances from one another, held between endless conveyor belts of a covered belt system, from a separation device to modules arranged downstream therefrom, where they are read, processed and sorted. Whilst the mail items are transported in the covered belt system, which is interrupted by points, conveyor belt disconnection points etc., the mail items can be displaced in respect of one another as a result of different physical characteristics such as for instance friction coefficients, thickness, bending strength, to a differing degree in relation to the transport means and thus as a function of the mail item sequence, thereby adjusting the gaps. The relative displacement of the mail items in respect of one another and associated therewith the partial reduction in the gaps between the mail items, which as a first approximation represents a linear function of the different transport section distances (point section and/or covered belt section) to the respective sorting terminals, mean that a set gap set in the separation device has to be travelled, above all in the case of long sorting machines with many sorting terminals, said set gap having a high percentage of probability of displacement to the machine end and the necessary minimum gap for ejection of the mail items by the points with little disruption. As only a small percentage of mail items may be discharged to reject terminals resulting from extreme displacement of the mail items in respect of each other, relatively large, standard set gaps have hitherto been set in the separation devices for each machine as a function of the machine length, to ensure reliable ejection of the mail items for all sorting terminals, thereby resulting in a reduced throughput.

In this context, U.S. Pat. No. 6,023,034 A describes a method and a device for sorting flat mail items, with which the maximum displacements occurring during transport to the sorting terminals are determined in statistical surveys as a function of the sorting terminals. A controllable gap adjustment device then allows the gaps between the mail items to be adjusted individually within the context of possible options, such that excessively small gaps are enlarged to the minimum value at the expense of subsequent larger gaps by decelerating the relevant mail item.

JP 2000-024 598 A further discloses combining the sorting terminals to form two segments arranged one behind the other and to individually adjusting the gaps as a function of the transport distance to the segments.

SUMMARY OF THE INVENTION

The object underlying the invention is to create a method and a device for sorting flat mail items, with which the throughput of sorting systems can be increased without increasing the transport speed.

According to the invention, the object is achieved by the features of claims 1 and 7.

The fundamental idea behind increasing the throughput is thus to generate a flow of mail items with gaps between the mail items by means of a controllable gap adjustment device, as a function of the transport distance to the assigned sorting terminal of the respective mail item, from the flow of mail items generated in the separation device with a standard set gap, which is smaller than the minimum gap required for the sorting terminals at the end of the machine (gap for reliable ejection in the points plus maximum displacement) and with which the assignment of the read destination addresses at the sorting terminals is known. This means that for mail items with destination addresses, the assigned sorting terminals of which are located in the front part of the sorting terminal area, the gap generated in the separation device must be reduced, and for mail items with destination addresses, the assigned sorting terminals of which are located in the rear part of the sorting terminal area, the gap generated in the separation device must be increased. The gap to be adjusted between two respective mail items with different destination addresses corresponds here to the gap for the mail item with the respective shorter transport distance to the assigned sorting terminal in each instance, since after this mail item has been ejected into its destination terminal a large gap results in respect of the front or subsequent mail item, as a result of which the average set gap of the separation device is smaller than the gap between the mail items, which are to be sorted in the sorting terminals with the longest transport paths. The input variable for gap adjustment is the gap required for the correct function of the points plus the displacement of the mail items in respect of one another as determined from the measurement values, as a function of the path length in the transport and point section.

Advantageous embodiments of the invention are set out in the subclaims of the invention.

It is thus advantageous for the average set gap between the mail items leaving the separation device to be greater than the minimum gap between the mail items for the sorting terminals with the shortest transport paths.

To reduce control outlay, the sorting terminals can advantageously be combined to form segments and the statistical surveys can be carried out as a function of the largest transport distances to the sorting terminals of the respective segments.

It is also advantageous to distribute the flow of mail items in the transport and point section via one or more points for very small minimum gaps to two or more transport and point portions with sorting terminals arranged one behind the other. The possible gap displacement and thus the number of mail items to be ejected is thus reduced.

It is furthermore advantageous to design the sorting plans such that the sorting terminals for very high-frequency destination addresses are located at the beginning of the transport and point section.

If a group of mail items arrives for the rear terminal area, for which not all the gaps can be enlarged, it is then advantageous to eject a subsequent mail item into a reject terminal arranged at the start of the sorting terminal region in each instance, if the gap between both mail items is smaller than the minimum permissible gap defined by the transport distances to the sorting terminals due to the displacement of the previous mail item.

The gap adjustment device advantageously comprises two transport units, in which the mail items are held and transported, with a first transport unit, which does not impede the transport of the mail items in the second transport unit, being arranged in front of the second transport unit with controllable speed.

As the forward displacement of the mail items in the transport direction is very restricted in the above gap adjustment device, it is advantageously possible optionally to transport a specific number of mail items beforehand via a shortcut transport section. This results in a defined forward displacement of such mail items in relation to the other mail items and they are subsequently positioned with the required gaps by means of the gap adjustment device described above.

To reduce possible gap displacements, it is advantageous to distribute the flow of mail items in the transport and point section over one or more points for very small minimum gaps to two or more transport and point portions with sorting terminals arranged one behind the other in each instance.

BRIEF DESCRIPTION OF THE SEVERAL VIEWS OF THE DRAWINGS

The invention is described in an exemplary embodiment below with reference to the drawing, in which.

DETAILED DESCRIPTION OF THE INVENTION

Figure 1:
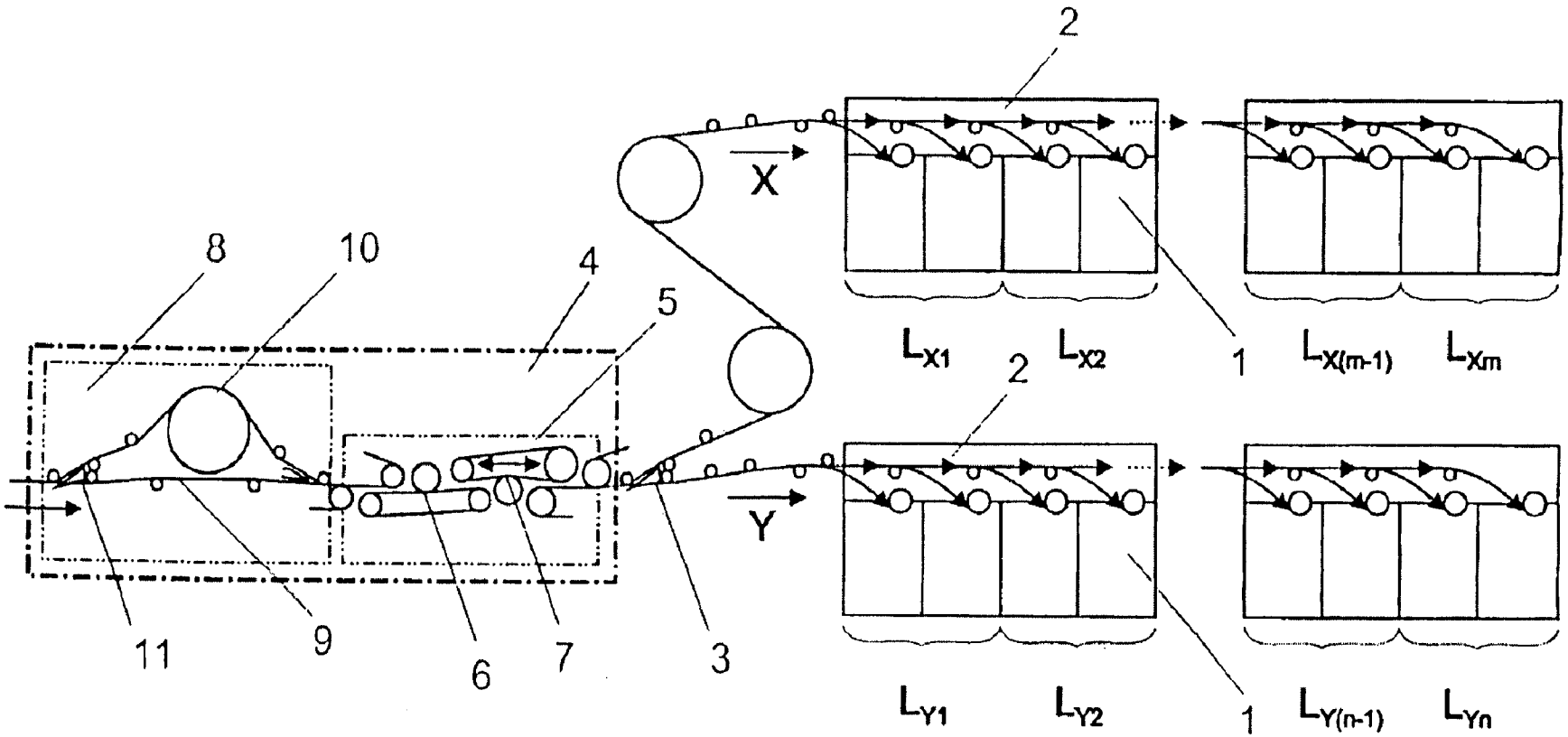
FIG. 1 shows a schematic top view of a sorting system with a gap adjustment device and two transport and point portions.

As shown in FIG. 1, the transport and point section 2 with the sorting terminals 1 is divided into two paths X and Y. The length of the transport and point section 2 is hereby reduced by half, thereby reducing the possible gap displacements.

The mail items leave a separation device (not shown) with a specific gap and reach a transport segment 8 via a read device (likewise not shown) with a bypass for a gap adjustment device 4 as a shortcut 9 compared with the normal transport path 10. Distribution to the different paths (for forward displacement purposes, mail items are routed into the shortcut) is carried out by means of a point 11.

Two transport units 6,7 which can be driven in a controlled manner then follow an acceleration and deceleration unit 5, in which the mail items are held and transported. The first transport unit 6, which does not impede the transport of the mail items in the second transport unit 7, is arranged in front of the second transport unit 7 with controllable speed, with which first transport unit 6 the mail items can be displaced in the flow of mail items in a specific manner (only to a minor degree forward, and without restriction backward).

Further details can be found in DE 197 53 419 C1. The mail items are subsequently distributed to the two transport and point portions 2, according to the read destination addresses, by means of a high-performance point 3 for very small minimum gaps, and are sorted into the assigned sorting terminals 1. In this way, two adjacent terminals are combined in each instance to form a segment.

Figure 2:
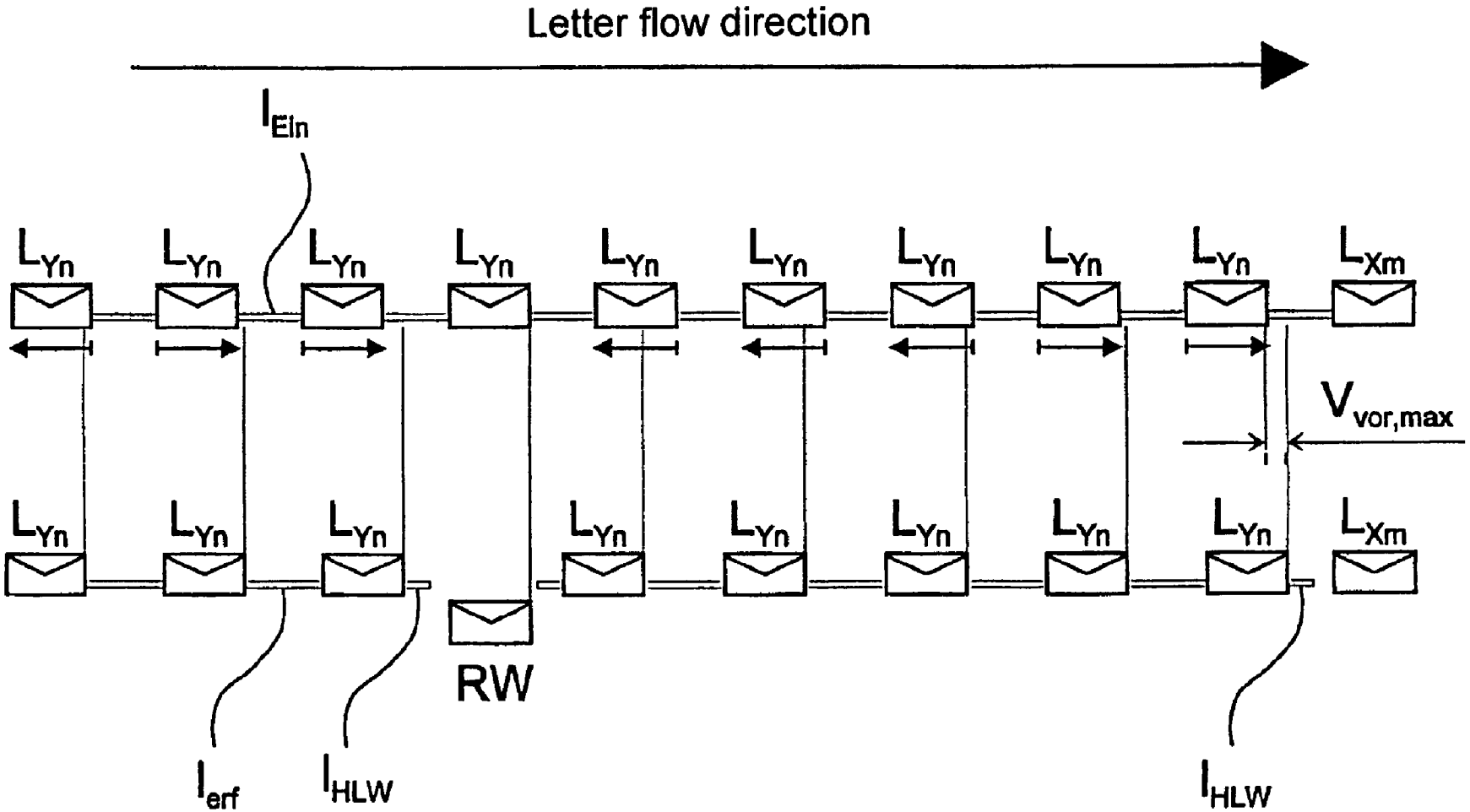
FIG. 2 shows a representation of the gap displacements, when a number of mail items are to be sorted one behind the other into the last sorting terminal segment of the X-path, with only a limited possible forward displacement.

FIG. 2 shows a gap displacement process, whereby a forward displacement can only be carried out to a small degree with $V_{Vor,max}$. The upper row shows the arriving mail items with the corresponding mail item gaps. The front mail item must be routed into the last sorting terminal segment $L_{xm}$ according to its destination address and all subsequent mail items shown are routed into the last sorting terminal segment $L_{yn}$ of the other transport and point portion Y. As the so-called input gaps $l_{Ein}$ of the arriving mail items are smaller than the gaps required for the last segment and determined previously in test runs, the mail items must be displaced in order to enlarge the gaps.

The relative position of the mail items in respect of one another after displacement is shown in the lower row. As the front mail item is routed into the X portion, a larger gap, which can be used for forward displacement, results for the subsequent mail item, said gap only being reduced by the gap required for the reliable switching of the high-performance point 3. This displacement option can however not be fully utilised, because the forward displacement is restricted to the value $V_{Vor,max}$. As the gap thus resulting for the subsequent mail item for the last sorting segment $L_{yn}$ is greater than the required gap $l_{erf}$, this subsequent mail item can likewise be displaced forward. The arrows under the mail items show the displacement directions. The backward displacements of the further subsequent mail items in the flow can be implemented until the gap becomes smaller than the gap required for the high-performance point 3 with a further displacement. As this is not allowed, the mail item, the displacement of which is no longer possible, must be ejected into a reject terminal, preferably at the start of the point section. The resulting larger gap means that the mail item following the larger gap can be displaced forward again, etc.

Figure 3:
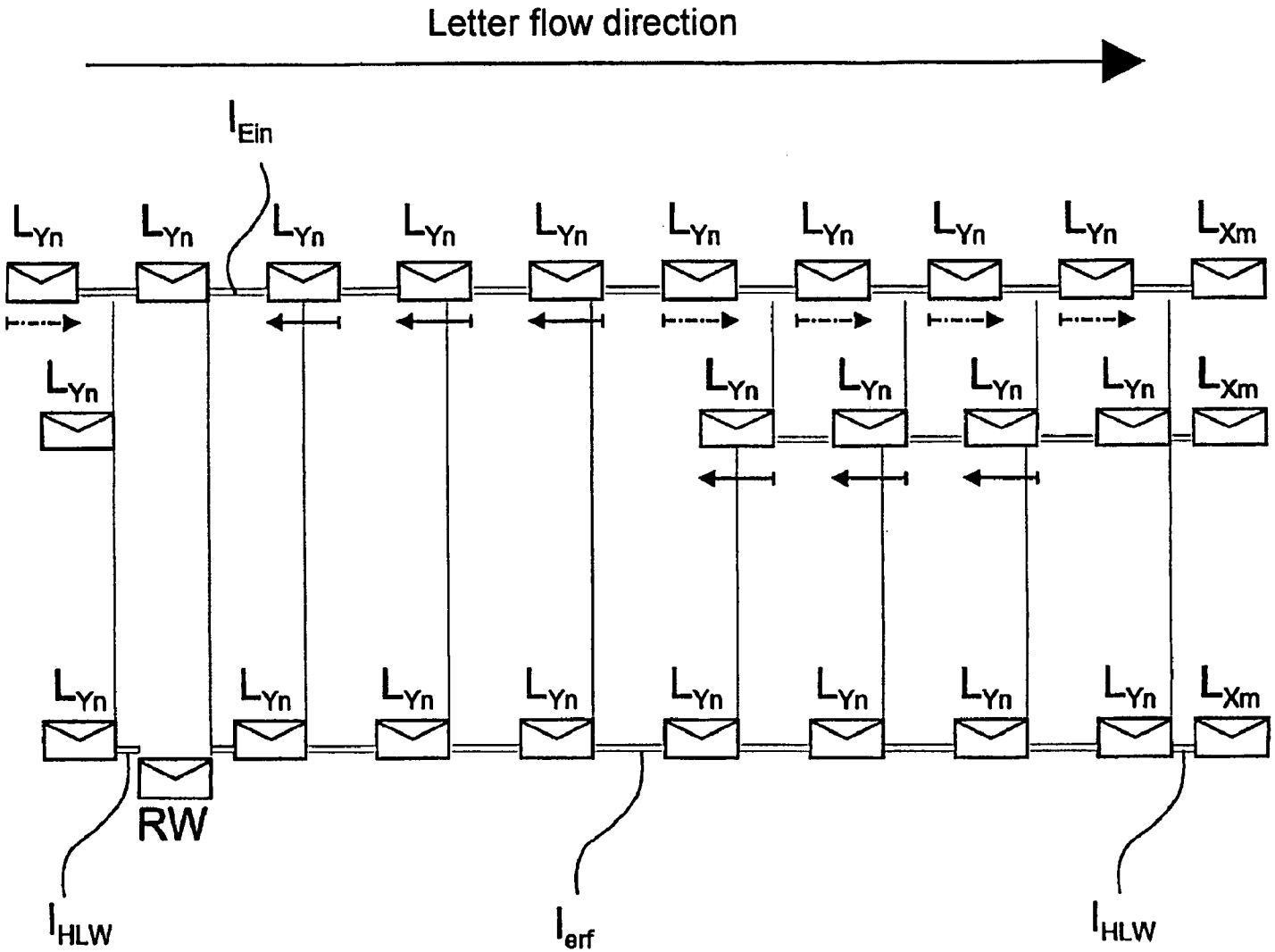
FIG. 3 shows a representation of the gap displacements, when a number of mail items are to be sorted one behind the other into the last sorting terminal segment of the X-path, with extended possible forward displacement.

FIG. 3 shows the gap adjustment of the incoming mail items as in FIG. 2 by using the shortcut to enlarge the maximum forward displacement. The displacement possibilities can thus be fully utilised, i.e. the first mail item for the sorting terminal segment $L_{yn}$ is displaced so far forward that the gap just suffices to activate the high-performance point 3 is precisely enough. In the upper mail item row, the arrows in the letter flow direction show the forward displacement of the mail items by the fixed amount through the shortcut section, the mail item row below shows the subsequent displacement of these mail items transported via the shortcut, resulting in the flow of mail items shown below with the required gaps. As shown, a mail item must be ejected into a reject terminal later, i.e. not so frequently. As the input gaps are not precisely identical as a result of different mail item characteristics, a correction of the different input gaps takes place in the gap adjustment device, superimposed with the gap adjustment to correspond to the gap required for the respective transport and point section length. If the successive mail items in the flow of mail items does not have to be routed into the same rear sorting terminal segment, which is normally the case, sufficient displacement space is usually available, which obviates the need for ejection.

The invention claimed is:

1. A method for routing, via a transportation path, a flow of flat mail items one behind the other in a longitudinal direction according to determined destination addresses and for sorting the flat mail items into sorting outlets depending on recognized destination addresses of the mail items, the method comprising the steps of:

setting an average set gap between two mail items to be smaller than the minimum gap between those mail items that are to be transported the longest transport distances to the outlets;

after the setting step and before the two mail items enter the transportation path, adjusting a gap between the two mail items with a controllable gap adjustment device, such that the mail items are transported into the corresponding outlets reliably, the gap between the two mail items being adjusted by:

creating, with the controllable gap adjustment device, a gap of individual length between the two mail items utilizing a given function of transport distances to assigned sorting terminals and a maximum relative shift of the mail items during transportation, the gap between two mail items being adjusted as a function of that mail item having the shorter transport distance to the assigned outlet; and ejecting from a flow of mail items, a mail item that disturbs the flow, to create a necessary space between two consecutive mail items in the flow of mail items to adjust the gap between the two consecutive mail items individually, according to the minimum gap.

2. The method of claim 1, wherein the average set gap between the mail items leaving the separation device is greater than the minimum gap between the mail items for the sorting terminals with the shortest transport paths.

3. The method of claim 1, further comprising the steps of combining the sorting terminals to form segments and carrying out statistical surveys as a function of the largest transport distances to the sorting terminals of the respective segments.

4. The method of claim 1, wherein the ejecting step includes distributing the flow of mail items in the transportation path via one or more points for very small minimum gaps to two or more transportation path portions with sorting terminals arranged one behind the other.

5. The method of claim 1, wherein the sorting terminals for high-frequency destination addresses are arranged at the beginning of the transportation path.

6. The method of claim 1, wherein the ejecting step includes ejecting a subsequent mail item into a reject terminal located at the start of the sorting terminal area, if, due to the displacement of the previous mail item, the gap between the two mail items becomes smaller than the minimum permissible gap defined by the points of the sorting terminals.

7. A device for sorting flat mail items in a sorting machine, with a separation device, a read device, a transportation path, sorting and reject terminals, a controllable gap adjustment device in front of the transportation path and a controller, wherein:

the separation device configured to set an average set gap between the mail items leaving a separation device to be smaller than the minimum gap between the mail items that are to be sorted in the sorting terminals with the longest transport distances, the controllable gap adjustment device being configured to adjust the gaps between two mail items as a function of the mail item with the shorter transport distance to the assigned sorting terminal in each instance; and the controllable gap adjustment device additionally being configured to eject from a flow of mail items a mail item disturbing the flow of mail items such that a necessary space between two consecutive mail items in the flow of mail items is created and a gap between those two mail items is adjusted individually, according to the minimum gap.

8. The device of claim 7, wherein the gap adjustment device comprises two transport units driven in a controlled manner, in which the mail items are held and transported, with the first transport unit which does not impede the transport of the mail items in the second transport unit being arranged in front of the second transport unit with controllable speed.

9. The device of claim 8, wherein the gap adjustment device additionally comprises a shortcut transport section, which is positioned in front of the transport units and the mail items can optionally be routed via a point into the shortcut transport section.

10. The device of claim 7, wherein the flow of mail items in the transport and point section can be distributed via one or more points for very small minimum gaps to two or more transport and point portions with sorting terminals arranged respectively one behind the other.

* * * * *